United States Patent [19]

Dabby et al.

[11] Patent Number: 4,831,638

[45] Date of Patent: May 16, 1989

[54] GARMENT HANGER AND COUNTING SYSTEM

[76] Inventors: Joseph Dabby, 4615 Madison Avenue, Montreal, Quebec, Canada, H4B 2V5; Barry Gurberg, 5555 Plamondon #6, Brossard, Quebec, Canada, J4W 1H1

[21] Appl. No.: 93,557

[22] Filed: Sep. 8, 1987

[51] Int. Cl.[4] ..... G06M 1/272; G06M 11/00

[52] U.S. Cl. ..... 377/6; 377/53

[58] Field of Search ..... 377/6, 53

[56] References Cited

U.S. PATENT DOCUMENTS 3,008,614 11/1961 Ullery ..... 223/88

4,097,725 6/1978 Lieberman et al. ..... 377/6

4,151,402 4/1979 Fernandez et al. ..... 377/6

*Primary Examiner*—John S. Heyman

[57] ABSTRACT

A garment hanger and counting system has cutouts in the hook portion so a counter can count each hanger even when they are side by side. The counter is not affected by garments supported on the hanger. The hanger has cutouts on an open end side of the hook portion and the neck side of sufficient depth so that a counter counts the hangers whichever way they are hung on a hanging bar. The system includes hangers and a hanger counter with a modulated light source converging beam optics to a focal point, a photodetector to produce a signal from each hanger, and an indicator to determine the number of hangers counted.

9 Claims, 4 Drawing Sheets

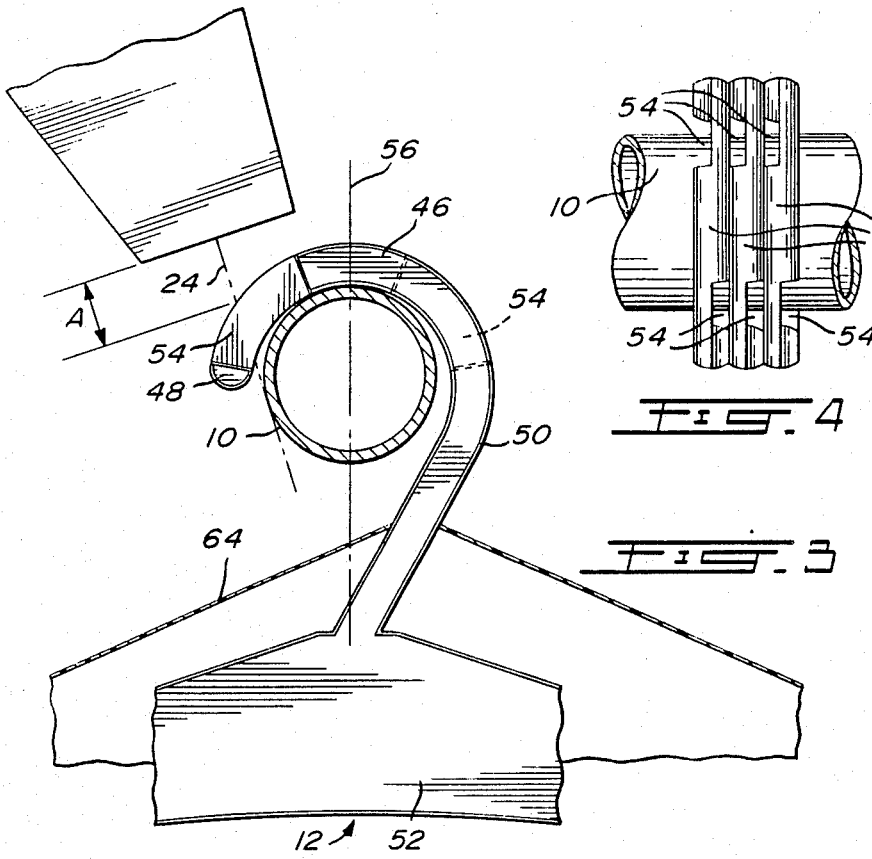
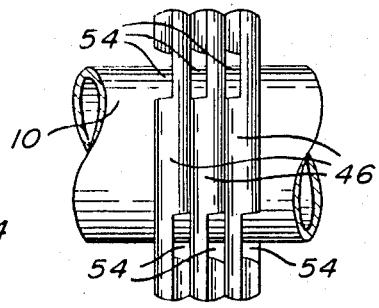
FIG. 4
FIG. 3
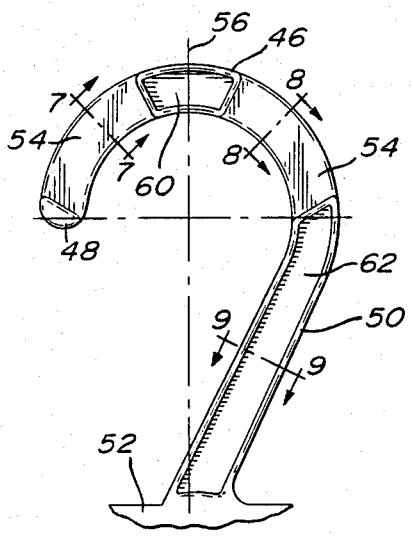
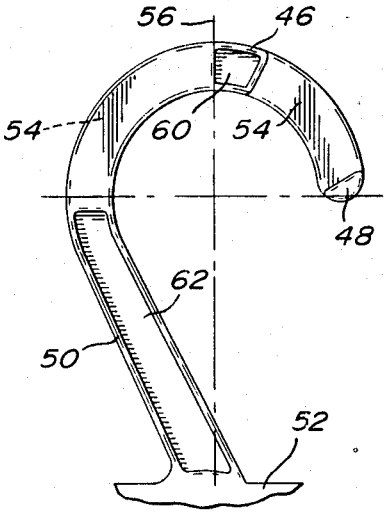
FIG. 5
FIG. 6

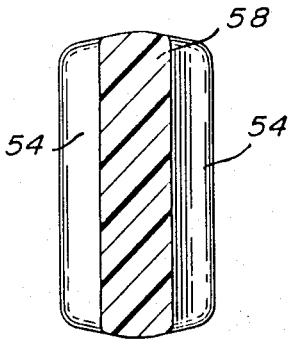
FIG. 7
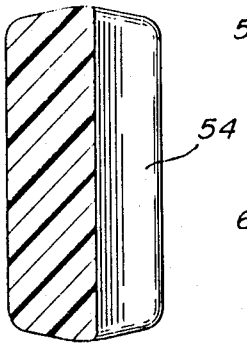
FIG. 8
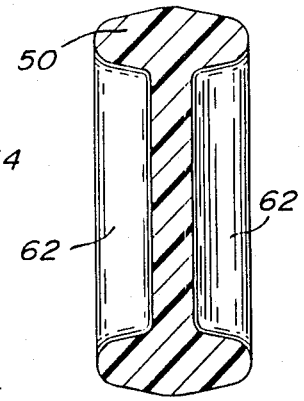
FIG. 9
FIG. 12
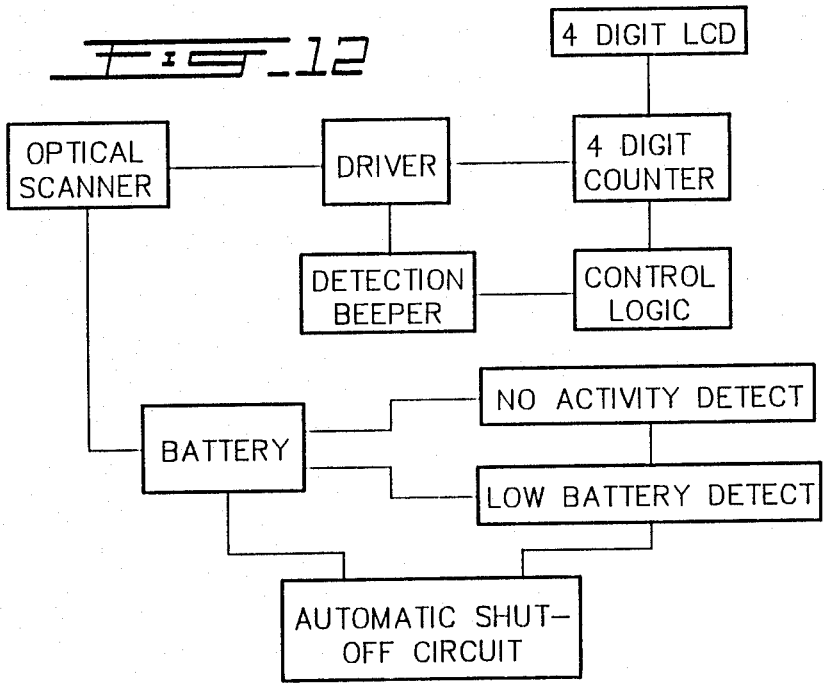

GARMENT HANGER AND COUNTING SYSTEM

The present invention relates to counting garments supported on hangers. More specifically the present invention relates to an optical scanning system for counting garment hangers on a hanging bar.

In the garment industry there is a requirement in both the manufacturing and retail process for a fast system of counting garments supported on garment hangers. To count row upon row of hangers stacked side by side and face to face is both time consuming and often inaccurate. Various devices have been suggested to count hangers. In one case a wand system is provided such as that disclosed in U.S. Pat. No. 4,097,725. The wand system, however, relies on an individual ensuring that the wand is always held in the same elevation relative to a hanging bar with hangers thereon, and this does not always occur. Consequently, these systems invariably result in errors occurring during the counting process.

Other types of counting devices have been suggested. Another example is disclosed in U.S. Pat. No. 4,151,402 wherein hangers are moved past a light beam and a photosenser counts the number of hangers on a hanging bar. In this patent, the hangers have cutouts in the neck below the hook portion. This is unsatisfactory because in some cases the garment or the plastic cover over the garment interferes with the cutout. In another embodiment the patent shows hangers having tabs either at the top or at the bottom of the hook portion of the hanger. The tabs protrude beyond the hanger configuration and in some cases break off. This results in a low count of garments. Alternatively, the hanger becomes somewhat skewed or twisted on the hanging bar which results in the tab missing the light beam which also gives an incorrect count.

Another embodiment in the same patent shows the hangers having a dark material or non-reflective material used in place of a cut out or groove. However, it has been found that this non-reflective material invariably wears off which is unsatisfactory. Still a further problem with existing types of hanging systems is that they require the hangers to be hung with the open hook only on one side of the bar. If one or more hangers are hung the other way around, they are not counted.

It is an aim of the present invention to provide a garment hanger which has no excess tabs projecting from the hanger, and which can be mounted on a hanging bar with the open hook on either side. The hanger has cutouts on the top portion of the hook so that gaps occur between the faces of adjacent touching hangers. The cutouts are large enough so that even if the hanger is slightly skewed, an optical scanner can scan this gap and count the number of hangers on the hanging bar.

It is another aim of this invention to provide a hanger counter which has an optical scanner directing a beam to a focal point and having converging beam optics so that a modulated light source is projected down and then reflected back to a photodetector which counts the number of pulses representing the number of hangers. Modulated light is used so that the photodetector rejects all background light and responds only to the light generated by the modulated light source. The hanger counter is arranged to be either fixed permanently to a position on the frame of a hanging system so that hanging bars on overhead rollers may move along a track and the light beam projects down through the gaps in the hangers left by the cutouts. The hanger counter may be portable and fitted with a slot that slides in a rod which is mounted at a fixed location from the hanging bar. Thus garments or plastic covers over garments on a hanger do not interfere with the optical scanner as the beam is directed downwards to the top of the hook portion of a hanger. Furthermore, the hanger counter is either in a fixed position or slides along a fixed track relative to the hanging bar. The distance and location between the optical scanner and the hook portion of the hanger always remains the same.

The present invention provides a garment hanger comprising a hook portion for hanging from a hanging bar, the hook portion having an open end side and a neck side joined to a shoulder portion to support a garment, two cutouts in at least one face of the thickness of the hook portion such that when at least two hangers are adjacent each other with faces touching, the cutouts provide gaps between the hangers, one cutout on the open end side of the hook portion and the other cutout on the neck side, the two cutouts substantially equispaced from a vertical center hanging axis, tee cutouts being of sufficient depth so that an optical scanner passing over at least one of the cutouts counts each individual hanger on a hanging bar even when the hanger faces are touching each other.

In another embodiment there is also provided a garment hanger counting system comprising: a plurality of hangers hanging on a hanging bar, each hanger having a hook portion with an open end side and a neck side joined to a shoulder portion to support a garment, two cutouts in at least one face of the hook portion such that when at least two hangers on the hanging bar are adjacent each other with faces touching, the cutouts provide gaps between the hangers, one cutout on the open side of the hook portion and the other cutout on the neck side, the two cutouts substantially equispaced from a vertical center hanging axis; a hanger counter having a modulated light source, converging beam optics to a predetermined focal point, a photodetector means to detect reflected light from an object substantially at the focal point and produce a signal for each object detected, control logic circuit fed by signals from the photo detector means to indicate the number of objects detected by the photodetector means on a counter means, the hanger counter positioned so that the focal point occurs at a position relative to the hanging bar where a cutout in a hook portion of a garment hanger occurs when the hanger is hanging on the hanging bar.

In drawings which illustrate embodiments of the invention:

FIG. 3 is a partial sectional view through a hanging bar showing the hook portion of a hanger with an optical scanner positioned to count the hanger;

FIG. 4 is a top plan view of a number of hangers hanging on a hanging bar;

FIGS. 5 to 9 show detail views of another embodiment of a hook portion of a hanger;

FIG. 12 is a block diagram of the scanning and counting system.

Figure 1:
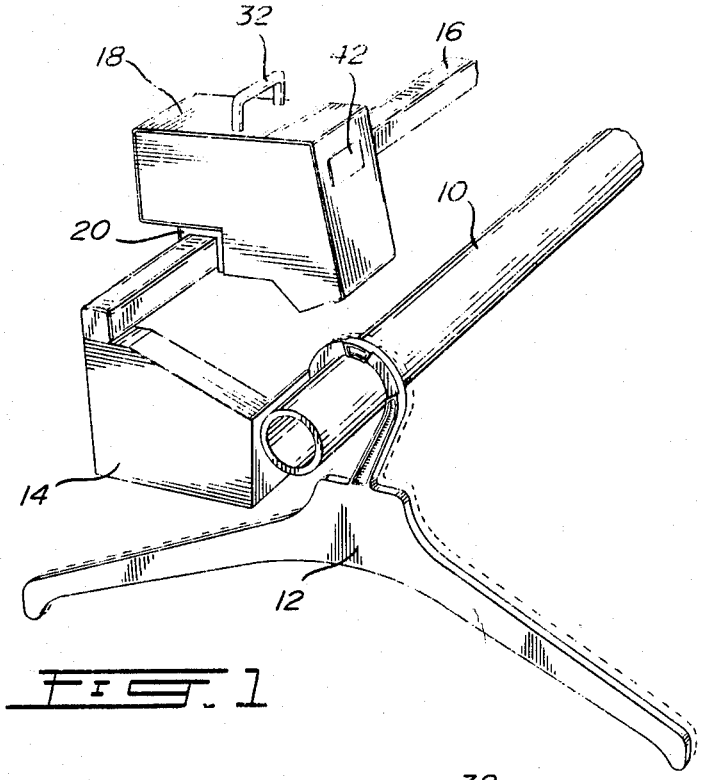
FIG. 1 is an isometric view showing one embodiment of a garment hanger counting system.
Figure 2:
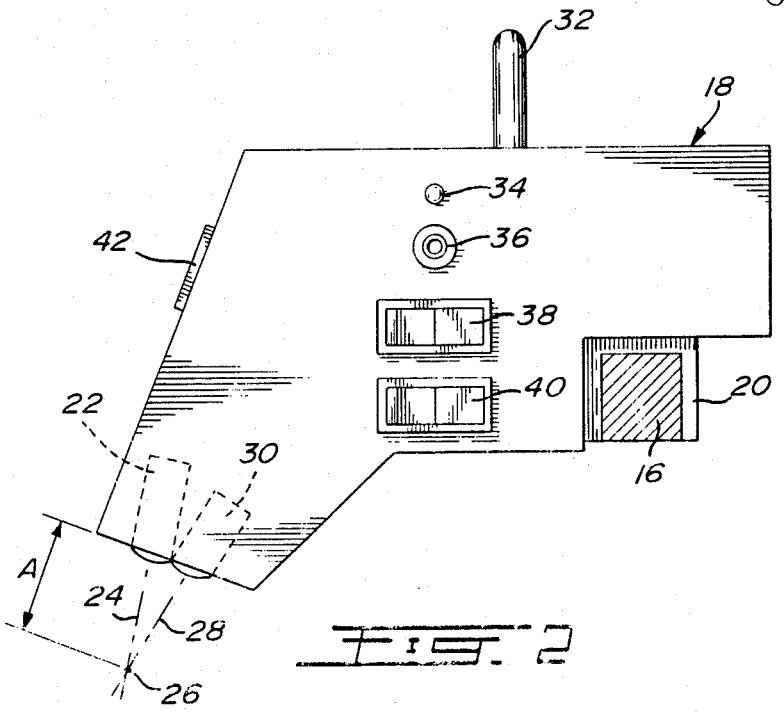
FIG. 2 is a side view of a hanger counter as illustrated in FIG. 1.

A hanging bar 10 is illustrated in FIG. 1 with a number of hangers 12 thereon. A bracket 14 extending from the hanging bar 10, positions a square rod 16 which extends parallel to the hanging bar 10. On the square rod 16 there is a hanger counter 18 which has locating grooves to move up and down the rod 16. Thus as the hanger counter 18 is moved backwards and forwards, the optical scanner always remains exactly the same distance and at the same position relative to the hanging bar 10 and hence the hangers 12. FIG. 2 illustrates the hanger counter 18 showing the slot 20 which fits over the square rod 16 as illustrated in FIG. 1. The slot 20 locates the hanger counter 18 permitting little or no rocking or tilting, but permitting the hanger counter 18 to be slid backwards and forwards on the rod 16. The optical scanner portion of the hanger counter provides a modulated light source 22 projecting an optical beam 24 of modulated light at a downward angle to a focal point 26. The light is reflected from this focal point, in a converging beam 28 which is detected by a photodetector 30 located adjacent the modulated light source 22. Thus you have converging beam optics ensuring that any item located at the focal point 26, provided it has a reflective surface, reflects a pulse of light from the light source 22 to the photodetector 30. The distance of the focal point 26 from the optical scanner is in one embodiment 0.90 inches and the optical scanner is blind ,to objects a short distance before and beyond the focal point 26. This dimension may be varied as desired by changing the optics. The light source 22 may be a modulated visible or infrared LED source and the photodetector 30 is preferably a solid state unit. Modulated light is preferred to avoid background light.

As will be described hereafter, the hanger counter 18 as shown in FIG. 2 is battery operated and has a handle 32 for carrying the unit. A charging light 34 and a charging connector 36 ar provided for the rechargeable battery, an on/off switch 38 and a reset switch 40 are also provided, the reset switch 40 resets the counter display 42, as shown in FIG. 1, back to 0.

Details of one type of hanger 12 are illustrated in FIGS. 3 and 4 wherein a hook portion 46 has an open end side 48 and a neck side 50 which in turn is joined to a shoulder 52 for supporting a garment. Two cutouts 54 are provided on opposing faces of the hook portion 46. The two cutouts 54 are substantially the same size and are positioned equi-distance apart on a center hanging axis 56. When two or more hangers are placed side by side with the neck portions face to face as shown in FIG. 4, the cutouts 54 represent gaps between hangers and it is this arrangement of gaps that ensures that the optical scanner counts the portions of the hanger between the gaps so that each hanger is counted regardless of whether or not the hook portions 46 are face to face. By having two cutout portions, the hanger may be positioned on the hanging bar 10 with the open side 48 on either side of the bar. The optical scanner scans and picks up at least one of the cutouts 54 on each hanger. This permits there to be no restrictions as to how a hanger is placed on a hanging bar 10. Furthermore, the cutouts 54 are of sufficient width so that even if a hanger tends to tilt or is somewhat twisted when hanging on the hanging bar 10, the optical beam 24 of the converging beam optics still passes through the cutout 54. As illustrated in FIG. 4, in one embodiment of a hanger, the depth of the cutout 54 is approximately half the thickness of each hook portion 46. However, as long as the cutout 54 is sufficient so that the optical scanner pulses for each hanger, then it satisfies the requirements.

Figure 10:
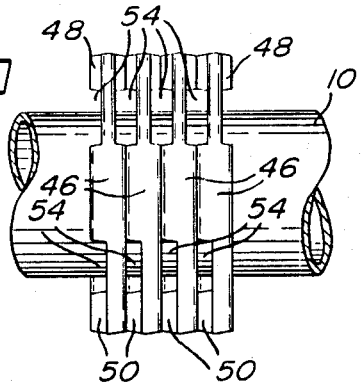
FIG. 10 is a top plan view of a number of hangers as shown in FIGS. 5 to 9 hanging on a hanging bar.

FIGS. 5 to 9 illustrate a preferred embodiment of a hook portion 46 of a plastic hanger. The cutouts 54 adjacent the open end side 48 are made on both faces of the hanger as seen in FIG. 7 leaving a center rib 58. The cutout 54 adjacent the neck side 50 is on one face and as can be seen in FIG. 8 extends for a depth just slightly more than half the thickness of the hook portion 46. Recesses 60 are left in the top of the hook portion 46 between the cutouts 54 during the molding step to save material. Further cutouts 62 are also formed on both sides of the neck 50 for the same purpose. By restricting the amount of plastic, the cost of hangers is the same as the equivalent standard plastic hanger. FIG. 10 shows the cutouts 54 forming gaps between the hangers as both sides of the center hanging axis.

The optical beam 24 as shown in FIG. 3 is arranged to project downwards tangentially to the hanging bar 10 with the focal length A positioned at the top edge of the hook portion 46. In this location, there is no concern that the garment or a plastic cover 64 which is often used to protect a garment interferes with the optical beam 24. As can be seen in FIG. 3, the plastic cover 64 often comes up almost to the underside of the hanging bar 10 and, therefore, interferes with the neck 50 of the hook portion 46.

Different implementations for the sides of the hook portion 46 may be made than the two embodiments shown to save material in manufacturing the hanger by adding extra cutouts of just ribs formed in the material. Such implementations lower the cost per hanger by using less plastic material without compromising the requirements for full sides on the neck. The plastic material is preferably white or a light color to ensure that it reflects the beam from the modulated light source 22 back to the photodetector 30. The reflective surface on the hanger may be black, either shiny or mat, and the photodetector 30 adjusted to detect and count black hangers. Furthermore the photodetector may be set to count black hangers and not white hangers or vice versa. In another embodiment, the photodetector may be set to count modified metal hangers.

Figure 11:
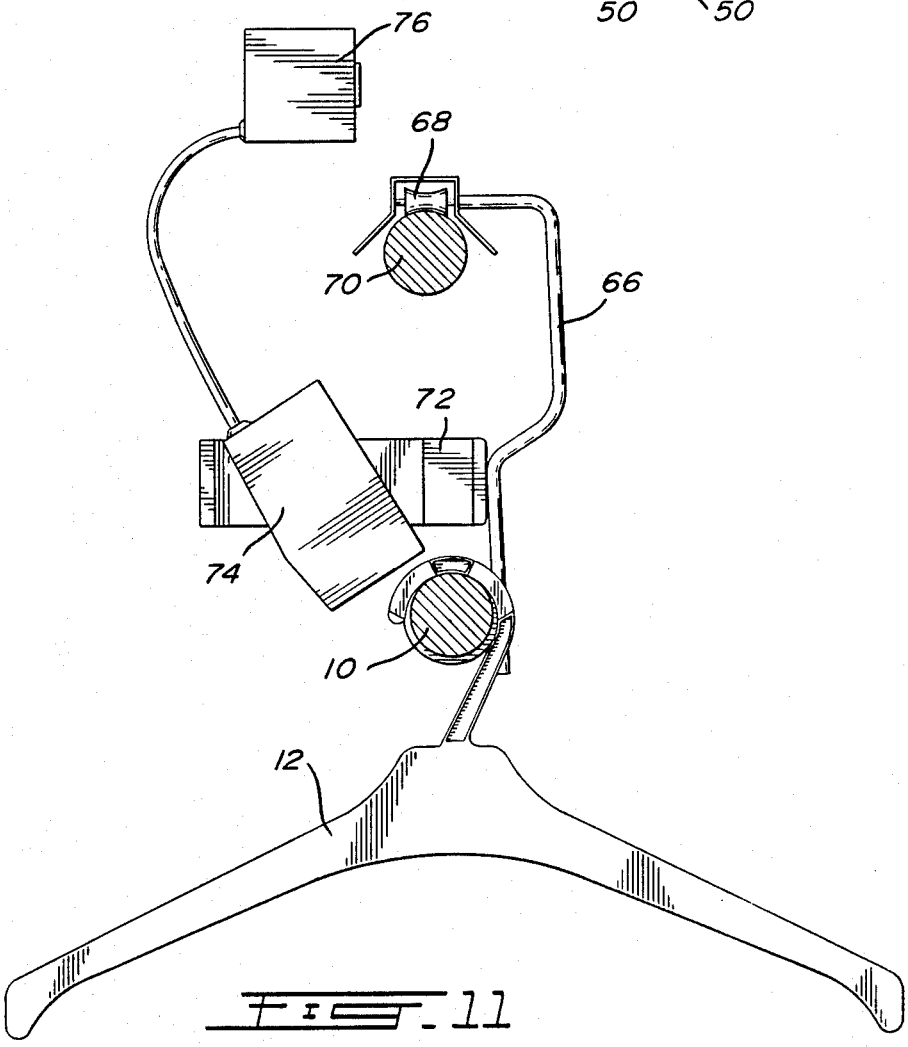
FIG. 11 is an end view of another embodiment showing a hanging bar supported by rollers from a top track and having a fixed hanger counter.

FIG. 11 illustrates another embodiment which is called a "rolling rack" wherein the hanger bar 10 is supported at each end by a hanging bracket 66 attached to a roller 68 riding on a top track 70 which in this particular instance is illustrated as a tubular or round rod. Thus the whole hanging bar 10 moves along beneath the track 70 with the hangers 12 and the garments thereon. Such installations are generally required where a large amount of merchandise is processed. A gate 72 is provided where an optical scanner is to be positioned. The gate 72 slightly deflects the bracket 66 to one side so that gravity causes the bracket 66 to rest against the gate 72 and does not permit the bracket to swing. This locates the hanging bar 10 to remain in the same position. An optical scanner unit 74 performs the same function as previously described, is permanently located on the gate 72 and counts the hangers 12 as the rolling rack moves. A separate digital counter unit 76 is provided at a convenient location so the number of hangers passing the optical scanner unit 74 can be seen by an operator. Two permanent counter gates 72 positioned on opposite sides, may be used as a check for the rolling rack system. The gates 72 stabilize the hanger bar 10 placing the hangers at the right level and distance from the optical scanner 74 for counting.

The block diagram shown in FIG. 12 illustrates the operation of the optical scanner. When the converging beam 28 hits the photodetector 30, the photodetector generates an output pulse representing every hanger detected. Each pulse is counted by a four digit counter which by means of the driver and control logic circuit drives a four digit liquid crystal display. The pulses are also used to generate a short beep for every hanger detected as an operational feedback to the user. The counter 42 is reset by the reset switch 40 as shown in FIG. 2.

The counter is powered by a rechargeable battery. An appropriate battery is 12 V. although other voltages may be used with or without connectors. To extend the battery charge life an automatic shut off circuit is included. This circuit turns power off if the counter is left on, but not used for more than three minutes. It also flashes the display colons for about five minutes to show that the battery is discharged before shutting power off. If the power is automatically shut off due to no activity, the reset switch 40 restores it. If, however, it is shut off for low battery, it can only be switched on by the power switch 38 after the battery has been charged. A fully charged battery operates the counter continuously for a minimum of eight hours. It charges overnight by being connected to a battery charger circuit included in the counter which in turn is connected to a UL/CSA approved DC power source wall plug in unit.

In one embodiment the modulated light beam 24 is visible which is a check to ensure that the unit is operating.

Various changes may be made to the embodiments described herein without departing from the scope of the present invention which is limited only by the following claims.

The embodiments of the invention in which an exclusive property or privilege is claimed are defined as follows:

1. A garment hanger counting system comprising:

(a) a plurality of hangers hanging on a hanging bar, each hanger having a hook portion with an open end side and a neck side joined to a shoulder portion to support a garment, two cutouts in at least one face of the hook portion side that when at least two hangers on the hanging bar are adjacent each other with faces touching, the cutouts provide gaps between the hangers, one cutout on the open side of the hook portion and the other cutout on the neck side, the two cutouts substantially equispaced from a vertical hanging axis, and (b) a hanger counter positioned above the hanging bar, and having a modulated light source, converging beam optics downwardly to a predetermined focal point, a photodetector means to detect reflected light from an object substantially at the focal point and produce a signal for each object detected, control logic circuit fed by signals from the photodetector means to indicate the number of objects detected by the photodetector means on a counter means, the hanger counter positioned so that the focal point occurs at a position relative to the hanging bar where a cutout in a hook portion of a garment hanger occurs when the hanger is hanging on the hanging bar.

2. The system according to claim 1 wherein the hanger counter has a battery power source for the light source and control logic circuit.

3. The system according to claim 1 wherein the counter means for the hanger counter is a four digit display.

4. The system according to claim 2 wherein the hanger counter is in a portable enclosure and has a slot to fit over a rod fixed at a predetermined distance and parallel with the hanging bar, permitting the hanger counter to slide on the rod, but maintain the same distance and position relative to the hanging bar, the hanger counter adapted to be moved manually on the rod so the focal point of the hanger counter occurs where a cutout in a hook portion of each garment hanger hanging on the hanging bar occurs for the length of the hanging bar.

5. The system according to claim 4 wherein the hanging bar is supported by top support rollers on an overhead track and the hanging bar can be moved along below the overhead track, the hanger counter is in a fixed position and counts the hangers on the hanging bar when the hanging bar is moved along below the overhead track.

6. The system according to claim 5 wherein at least one guide gate is provided to push the hanging bar slightly to one side when the hanging bar is moved along below the overhead track thus stabilizing the hanging bar and placing the focal point at the correct position relative to the cutouts in the hook portions of the hangers hanging on the hanging bar as the hanging bar moves past the hanger counter.

7. The system according to claim 1 wherein the converging beam optics directs a modulated light beam from above the hanging bar in a direction tangential with the hanging bar, and the hanger can be located with the open end side facing in either direction still allowing one of the two cutouts to pass through the modulated light beam.

8. A garment hanger counting system comprising:

(a) a plurality of hangers hanging on a hanging bar, each hanger having a hook portion with an open end side and a neck side joined to a shoulder portion to support a garment, two cutouts in at least one face of the hook portion so that when at least two hangers on the hanging bar are adjacent each other with faces touching, the cutouts provide a gap between the hangers such that a gap so formed never faces another gap regardless of hanger orientation, one cutout on the open side of the hook portion and the other cutout on the neck side, the two cutouts substantially equispaced from a vertical center hanging axis; and (b) an optical scanner including a hanger counter positioned above the hanging bar and directed downwardly towards the hook portion of the hangers hanging on the hanger bar;

(c) said optical scanner detecting the gap formed by at least one of the cutouts on the hook portion of each hanger bar for counting the number of hangers on the counter bar.

9. The system according to claim 8 wherein:

(a) one of the two cutouts is located on one face of the hook and the other cutout is located on the opposite face of the hook portion so that the hanger may be positioned on the hanging bar with the open side thereof on either side of the bar.

* * * * *